US005663750A

United States Patent [19]

Sakuma

[11] Patent Number: 5,663,750

[45] Date of Patent: Sep. 2, 1997

[54] INK EJECTION DEVICE WITH INK SAVING MODE USED WHEN REMAINING INK AMOUNT IS SMALL

[75] Inventor: Mikio Sakuma, Ichinomiya, Japan

[73] Assignee: Brother Kogyo Kabushiki Kaisha, Nagoya, Japan

[21] Appl. No.: 416,934

[22] Filed: Apr. 4, 1995

[30] Foreign Application Priority Data

| | | | |
|---|---|---|---|
| Apr. 5, 1994 | [JP] | Japan | 6-067406 |
| Apr. 5, 1994 | [JP] | Japan | 6-067407 |
| Apr. 5, 1994 | [JP] | Japan | 6-067408 |
| Apr. 5, 1994 | [JP] | Japan | 6-067409 |

[51] Int. Cl.[6] ..... B41J 2/195; B41J 29/38

[52] U.S. Cl. ..... 347/7; 347/14

[58] Field of Search ..... 347/7, 10, 14

[56] References Cited

U.S. PATENT DOCUMENTS

| | | | |
|---|---|---|---|
| 4,908,635 | 3/1990 | Iwasawa et al. | 347/14 |
| 4,970,533 | 11/1990 | Saito et al. | 347/7 |
| 5,132,711 | 7/1992 | Shinada et al. | 347/7 |
| 5,136,309 | 8/1992 | Iida et al. | 347/7 |
| 5,160,969 | 11/1992 | Shiina et al. | 355/206 |
| 5,414,452 | 5/1995 | Accatino et al. | 347/7 |
| 5,576,746 | 11/1996 | Suzuki et al. | 347/14 |

FOREIGN PATENT DOCUMENTS

| | | |
|---|---|---|
| 53-12138 | 2/1978 | Japan . |
| 61-59914 | 3/1986 | Japan . |
| 2-150355 | 6/1990 | Japan . |

*Primary Examiner*—Benjamin R. Fuller
*Assistant Examiner*—L. Anderson
*Attorney, Agent, or Firm*—Oliff & Berridge

[57] ABSTRACT

An ink ejection device used, for example, in conjunction wit a host computer or a personal computer includes a head formed with orifices from which ink droplets are ejected to print a dot image on a printing sheet. The ink supplied to the head is stored in an ink reservoir. To properly continue printing when an amount of ink remaining in the ink reservoir is small, an amount of ink remaining in the ink reservoir is detected. When the detection results indicate that less than a predetermined amount of ink remains in the ink reservoir, then printing is performed using less ink than is used during normal printing.

25 Claims, 9 Drawing Sheets

INK EJECTION DEVICE WITH INK SAVING MODE USED WHEN REMAINING INK AMOUNT IS SMALL

BACKGROUND OF THE INVENTION

1. Field of the Invention

The present invention relates to an ink ejection device for ejecting ink droplets from orifices in a printing head. More particularly, the invention relates to an ink ejection device wherein printing can be properly continued when an amount of ink remaining in an ink reservoir is small.

2. Description of the Related Art

There has been known an ink ejection device with a means for determining when the level of ink in an ink cartridge, or other type of ink reservoir for supplying ink to the printing head, has run low. When the amount of ink is determined to have run low, a warning to that effect is displayed on a display unit or a buzzer is sounded to bring the low level to the user's attention. The user then replenishes the supply of ink by changing the ink cartridge, refilling the ink reservoir, or other method. When no ink or ink cartridge is available, the user must go to a store, buy ink or an ink cartridge, and then replace the ink before continuing to print.

Because the low ink level is announced by a display or warning buzzer, a user has no way of knowing that the level of ink is low unless he or she happens to be near the ink ejection device. Even if a user notices the buzzer or display, he or she may ignore it and continue printing without replenishing the ink supply. As a result, printing sheets may be outputted half printed with an image and half blank when the ink runs out totally. Also, air can enter the head when ink totally runs out, damaging the head.

These kinds of problems can occur when the ink ejection devices are used in printers or word processors. However, the problems become even more serious when the ink ejection device is used for a facsimile machine. Sometimes facsimile messages are received in the middle of the night or other time when no operator is present. Under such circumstances, it is impossible for a user to hear or see warnings about a low ink level. Also operators of remote facsimile machines have no way of knowing if the ink level is low and so will attempt to transmit messages. When the facsimile machine attempts to record the received facsimile message when ink is in short supply, sheets may be outputted half blank so that the facsimile message can not be understood. One method of preventing this problem is to store in a memory the portion of incoming messages that can not be printed because of low ink level. However, this solution requires addition of a large capacity reception memory, which would increase costs of producing the device.

SUMMARY OF THE INVENTION

The present invention has been made in view of the foregoing, and accordingly it is an object of the invention to provide an ink ejection device capable of properly continuing printing even if remaining ink amount is small.

It is another object of the invention to solve the above-described problems without increasing cost of the ink ejection device.

In order to achieve the above and other objects, there is provided an ink ejection device having a head formed with orifices from which ink droplets are ejected to print a dot image on a printing sheet, driving means for driving the head, and an ink reservoir holding ink. The ink reservoir is in fluid communication with the head for supplying the ink to the head. There is provided remaining ink detection means for detecting an amount of ink remaining in the ink reservoir. Control means controls the driving means so that the dot image is printed on the printing sheet using less ink than is used during normal printing when the remaining ink detection means detects that less than a predetermined amount of ink remains in the ink reservoir. The dot image is formed using less dots than used during normal printing through thinning.

The control means may control the driving means so as to start printing of the dot image using less ink when printing of a new page or new document is instructed.

The ink ejection device of the invention may further include calculation means for calculating a predicted amount of ink that would be consumed in printing the dot image and outputting a calculated result representative of the predicted amount of ink to be consumed, and comparison means for comparing the calculated result outputted from the calculation means with an amount of ink remaining in the ink reservoir. The comparison means outputs a control signal to the control means when the amount of ink remaining in the ink reservoir is less than the calculated result. The control means controls the driving means so as to form the dot image using less ink than is used during normal printing in response to the control signal.

The remaining ink detection means may detect whether or not the amount of ink remaining in the ink reservoir has reached a predetermined low level.

A second calculation means may be provided for calculating a predicted amount of ink to be consumed in printing the dot image when using less ink than is used during normal printing. The second calculation means outputs a second calculated result representative of the predicted amount of ink to be consumed when using less ink. The comparison means outputs a second control signal to the control means when the second calculated result is greater than the amount of ink remaining in the ink reservoir. In this case, the control means controls the driving means so as to interrupt printing operations.

Preferably, the ink ejection device includes selection means for selecting between a normal printing mode wherein normal printing is performed and an ink saving mode wherein less ink is used for forming images than in the normal printing mode. Signal output means is further provided in conjunction with the selection means for outputting a save ink control signal to the control means when the remaining ink detection means determines that the amount of ink remaining in the ink reservoir is less than the predetermined amount while the normal printing mode is selected by the selection means. The save ink control signal causes the driving means to print in the ink saving mode. The signal output means outputs a second control signal when the remaining ink detection means determines that the amount of ink remaining in the ink reservoir is less than the predetermined amount while the save ink printing mode is selected by the selection means. In this case, the control means controls the driving means to use less ink for forming the dot image than in the ink saving mode.

The remaining ink detection means further determines whether the amount of ink remaining in the ink reservoir is less than another predetermined amount that is less than the predetermined amount. The the signal output means further outputs a further save ink control signal to the control means when the remaining ink detection means determines that the amount of ink remaining in the ink reservoir is less than the another predetermined amount while the ink saving mode is selected by the selection means. The control means controls the driving means to print in a further ink saving mode that uses less ink than the ink saving mode in response to the further save ink control signal.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE PREFERRED EMBODIMENTS

A word processor according to a preferred embodiment of the present invention will be described while referring to the accompanying drawings.

Figure 1:
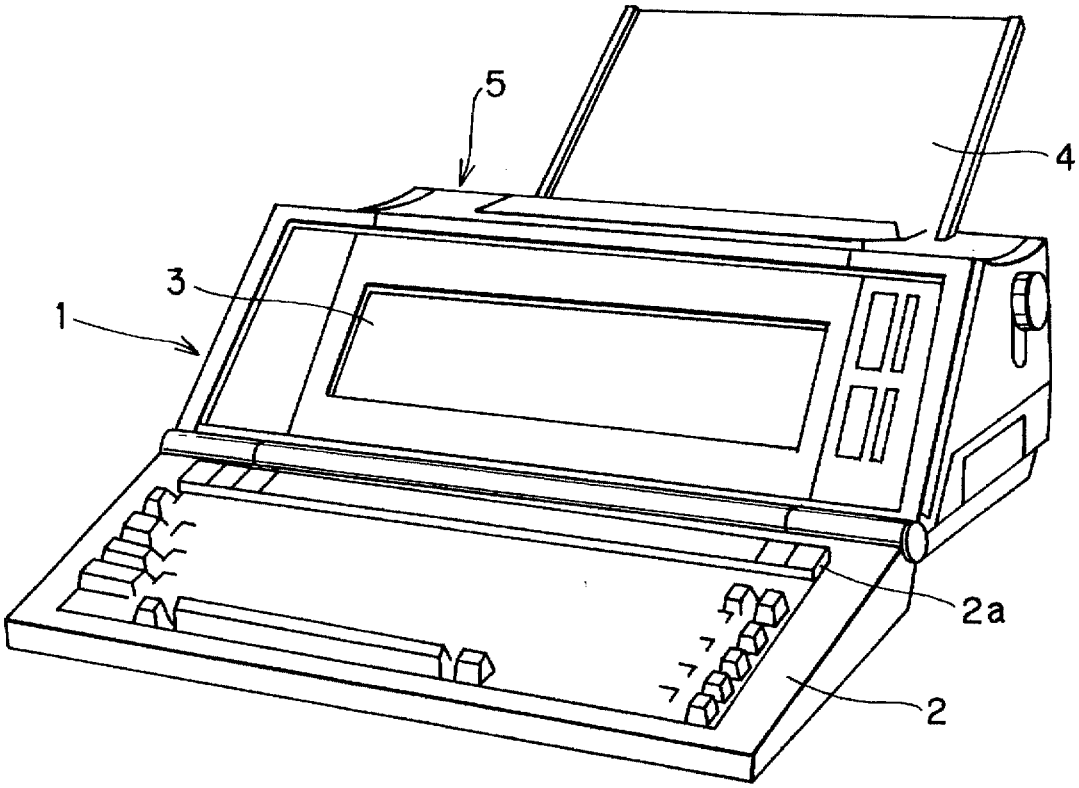
FIG. 1 is a schematic diagram showing a word processor according to one embodiment of the present invention.

The word processor 1 shown in FIG. 1 includes a keyboard 2 for inputting data such as text; a display 3 for displaying the inputted data; and a printing portion 5 for printing the inputted data on a printing sheet 4.

Figure 2:
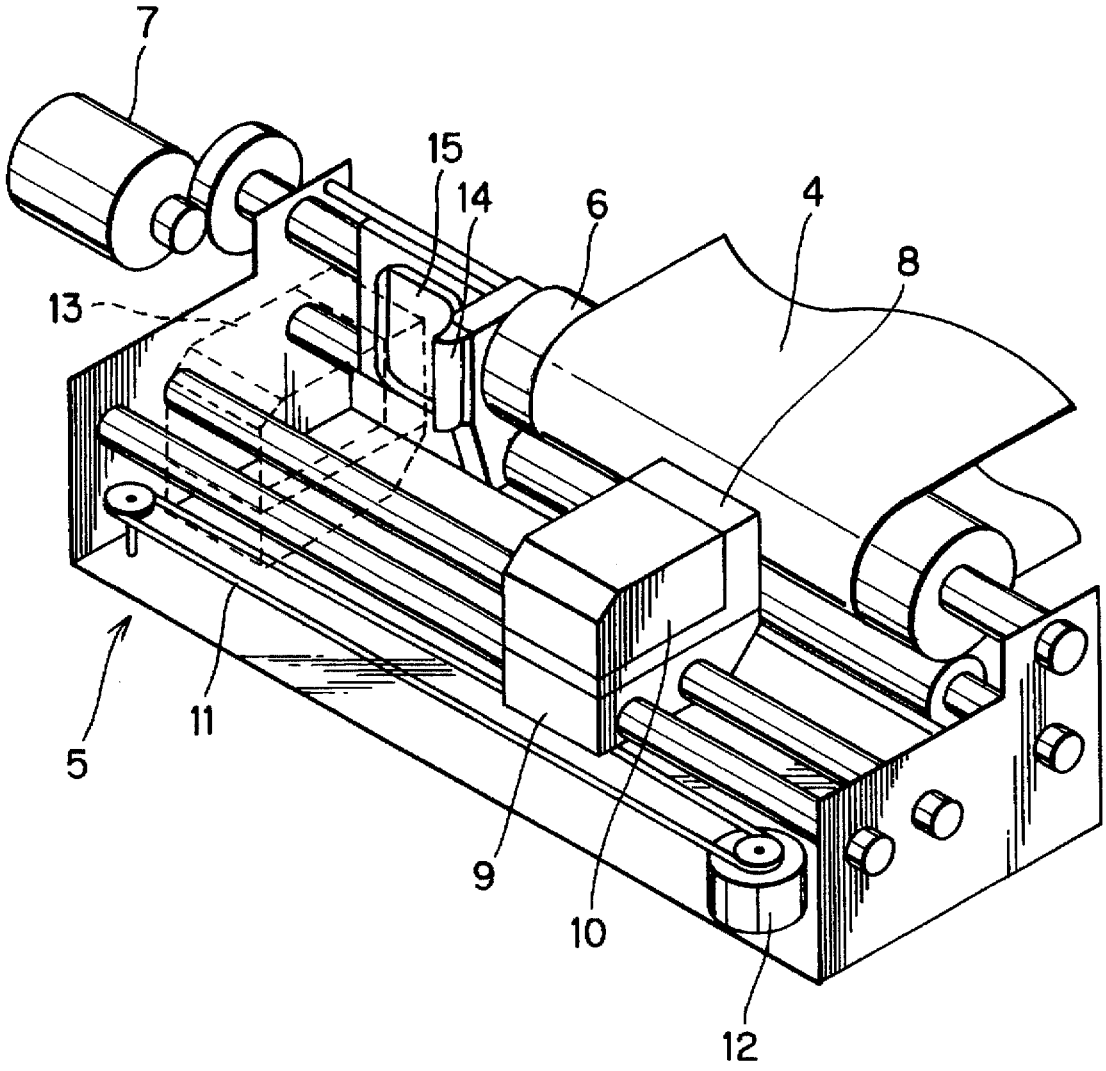
FIG. 2 is a perspective view showing a printing portion of the word processor shown in FIG. 1.

Details of the printing portion 5 will next be described while referring to FIG. 2. A platen 6 for supporting the printing sheet 4 in a predetermined posture and position is rotatably supported by a frame and is rotated by a motor 7. An ink jet head 8 (hereinafter referred to as "head 8") in confrontation with the platen 6 is mounted on a carriage 9 that is reciprocally movable in the longitudinal direction of the platen 6. An ink cartridge 10 is detachably mounted on the head 8. A drive belt 11 connects a carriage motor 12 to the carriage 9 so that the drive power of carriage motor 12 can be transmitted to the carriage 9. A wiper 14 for cleaning the orifice surface (not shown) of the head 8 and a suction means 15 for sucking ink out of the head 8 are provided at maintenance position 13 at one extreme edge of the platen 6. The wiper 14 cleans the orifice surface and the suction means 15 sucks ink out of the head 8 when the carriage 9 is moved to the maintenance position 13 at a predetermined timing.

Japanese Laid-Open Patent Publication No. SHO-53-12138 describes a Kyser-type ink ejection system for the head 8. Japanese Laid-Open Patent Publication No. SHO-61-59914 describes a thermal jet ink ejection system for the head 8, and Japanese Laid-Open Patent Publication No. HEI-2-150355 describes a shear mode ejection system for the head 8 which uses piezoelectric ceramics.

Figure 3:
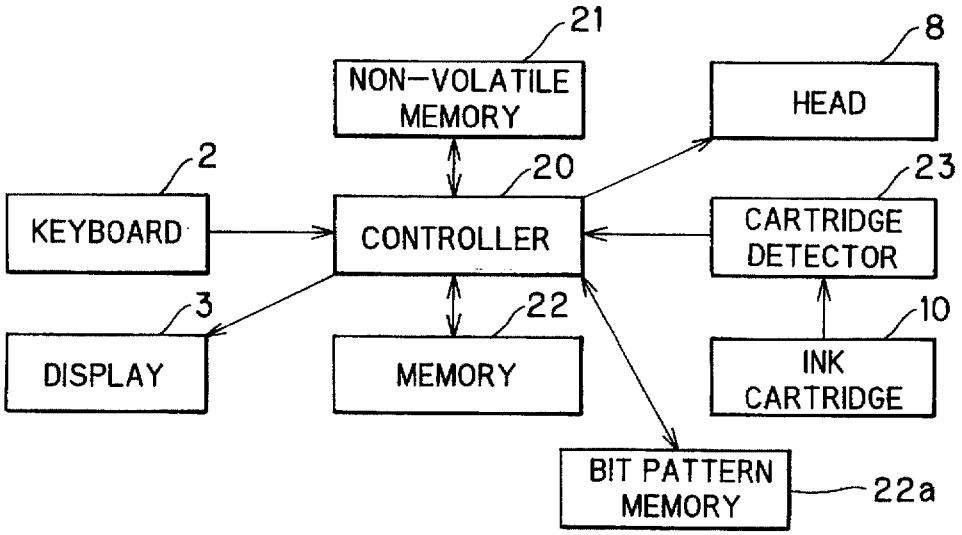
FIG. 3 is a block diagram showing a control system of the word processor shown in FIG. 1.

Next, a description of the control system of the word processor 1 will be provided while referring to the block diagram in FIG. 3. A controller 20 includes a CPU, such as a microprocessor, for controlling overall operations of the word processor 1; a ROM for storing data and control programs for the CPU; and a RAM which serves as a work area. The controller 20 is designed to calculate the total amount of ink consumed during operations of the head 8 and to convert the result into a remaining ink value. The controller 20 calculates the total amount of ink consumed based on the amount of ink ejected and the amount of ink sucked. The amount of ink ejected is determined using a coefficient of the drive signal applied to the head 8 and the amount of ink sucked is determined using a coefficient of suction operations by the suction means 15. The remaining ink value determined by the controller 20 is continuously updated as memory information in a non-volatile memory 21 that is connected to the controller 20.

The keyboard 2 is connected to the controller 20. Mode information, print start commands, text data, and the like are sent from the keyboard 2 to the controller 20. A mode selection key **2*a* is provided on the keyboard 2** so that a user can select between a normal printing mode and an ink saving mode. The same image is printed using less ink in the ink saving mode than in the normal printing mode. One method of accomplishing this is by ejecting smaller ink droplets during the ink saving mode than during the normal printing mode. By using the ink saving mode when printing first drafts of documents, or other times when the appearance of printed characters is not essential, users can reduce the amount of ink consumed.

A memory 22 for storing text data is connected to the controller 20. The text data stored in the memory 22 is transmitted to the display 3 where it is displayed. When a print start command is transmitted, the controller 20 calculates the amount of ink that will be consumed to print text data stored in the memory 22. The controller 20 makes this calculation by first developing all the text data into bit pattern data. The bit pattern data is then temporarily stored in a bit pattern memory **22*a* that is also connected with the controller 20. Then, the total number of dots in the bit pattern memory 22*a* is calculated. The volume of ink per dot (a previously known value) is multiplied to the total number of dots to obtain the amount of ink that will be consumed to print the text data stored in the memory 22**. Further, the number of times suction operations will be performed during printing of the text data is calculated beforehand to determine an total amount of ink consumed during suction operations. The amount of ink to be consumed during suction operations is added to the amount of ink to be consumed in printing the text data to obtain the total amount of ink.

An alternative calculation method for word processors that have no bit pattern memories is to determined the total number of characters printed based on the amount of capacity consumed in the memory 22. The total amount of ink to be consumed can then be determined by multiplying the average amount of ink consumed for printing one character to the total number of characters. Alternatively, the total number of pages printed can be calculated and the average amount of ink consumed for printing each page can be multiplied to the result.

When printing operations are started, the controller 20 outputs a drive signal based on the data stored in the bit pattern memory 22*a*. The controller 20 outputs the drive signal to the drive element (not shown) provided corresponding to each of the plurality of orifices formed on the head 8. Ink droplets are ejected from the orifices according to the drive signal. The ejected ink droplets impinge on the surface of the printing sheet 4 held in confrontation with the head 8 by the platen 6. The waveform of the drive signal in the present embodiment shows a single rectangular pulse of 30 volts with a duration (width) of L/a wherein L is the length of a pressure chamber (not shown) of the head 8 and a is the speed of sound in the ink filling the pressure chamber. L/a represents the duration of time required for a pressure wave to propagate once across the length of the pressure chamber.

A cartridge detector 23 is connected to the controller 20. The cartridge detector 23 is provided for detecting whether the ink cartridge 10 is mounted on the carriage 9. When the cartridge detector 23 detects that the ink cartridge 10 is mounted thereon, the controller 20 clears the remaining ink value stored in the non-volatile memory 21. When ink in the ink cartridge 10 is consumed by printing or suction operations, the controller 20 calculates the remaining ink value in one of the manners described above and constantly updates the value in the non-volatile memory 21. Because the remaining ink value is stored in the non-volatile memory 21, the remaining ink value will not vanish when the power of the word processor 1 is turned off.

When the amount of remaining ink becomes equal to or less than a predetermined value, the controller 20 displays a warning in a message region of the display 3 that says only a little ink remains in the ink cartridge 10.

However, no user may be near the word processor 1 to see the warning on the display 3. Alternatively, a user may see the warning but ignore it and continue printing. If printing is continued until the ink cartridge 10 runs out of ink, printing sheets 4 will be blank even after passing through the printing portion 5 or air might enter the head 8 and become the cause of a malfunction. To prevent these problems, a low level ink detector could be provided to the word processor and printing completely prevented when low levels of ink are detected. However, this method is not desirable because exchanging ink cartridges 10 even while a small amount of ink remains in the present ink cartridge 10 wastes ink, increases running costs, and increases the number of ink cartridges to dispose of.

A first embodiment of the invention will now be described while referring to the flowchart in FIG. 4. Individual steps will be referred to hereinafter as S followed by the step number. In S1, the controller 20 compares the remaining ink value stored in the non-volatile memory 21 with the remaining ink comparative value stored in the controller 20 and then determines whether or not only a little ink is left in the ink cartridge 10, that is, whether or not the level of ink in the ink cartridge 10 is low. When more than a little ink remains, normal printing, and, if necessary, also maintenance using the wiper 14 and the suction means 15 are performed in S2. In S2, the controller 20 calculates the total amount of ink consumed based on the amount of ink ejected, which is determined by a coefficient of the drive signal applied to the head 8, and the amount of ink sucked, which is determined by a coefficient of the suction operations performed by the suction means 15. The controller 20 converts the value of the total amount of ink consumed into the remaining ink value and accordingly updates the remaining ink value stored in the non-volatile memory 21.

When in S1 it is determined that only a little ink remains in the ink cartridge 10, in S3 the controller 20 displays on the display 3 a warning message that says only a little ink remains in the ink cartridge 10. In S4, the controller 20 changes the waveform of the drive signal applied to the drive elements of the head 8 in order to reduce the volume of each ink droplet ejected. In the present embodiment, during normal printing each droplet is ejected by application of a single rectangular pulse of 30 volts with a duration (width) of L/a. In S4, the waveform is changed to a single rectangular pulse of 20 volts so that ink droplets are ejected with volume only two-thirds the volume of droplets ejected during normal printing.

Next, in S5, the controller 20 determines whether or not the ink cartridge 10 has been exchanged based on detection results from the cartridge detector 23. If not, printing processes are continued in S6 using the modified drive signal. If the ink cartridge 10 has been exchanged, in S7 the drive signal is changed back to its original waveform and the remaining ink value stored in the non-volatile memory 21 is initialized. The program then returns to S2. When no data is left to be printed during either S2 or S6, the controller 20 terminates printing processes.

In the embodiment described above, the controller 20 changes the drive signal immediately upon detection of only a little remaining ink. However, if the drive signal is changed while the word processor is in the middle of printing a page of images, the beginning portion of the image will have a tone different from the tone of the end portion. As a result, the operator will have to again print the entire page after exchanging the ink cartridge 10.

Figure 4:
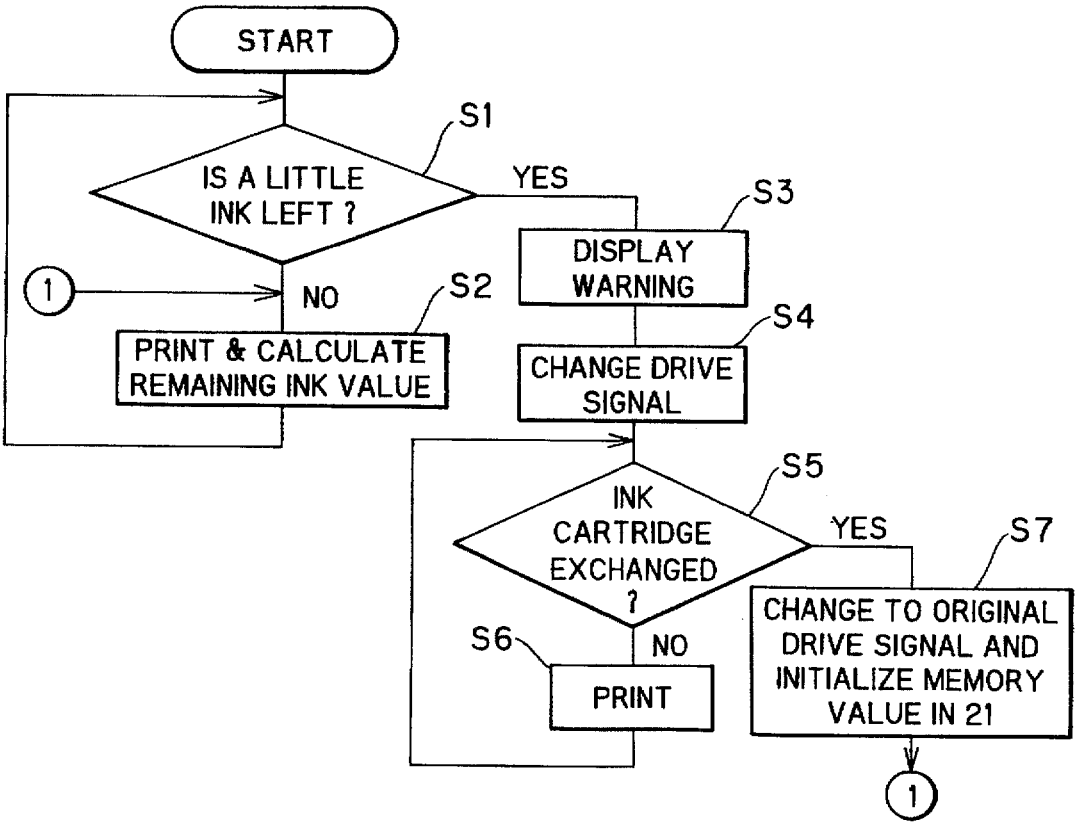
FIG. 4 is a flowchart illustrating a print control sequence of the word processor according to a first embodiment of the present invention.
Figure 5:
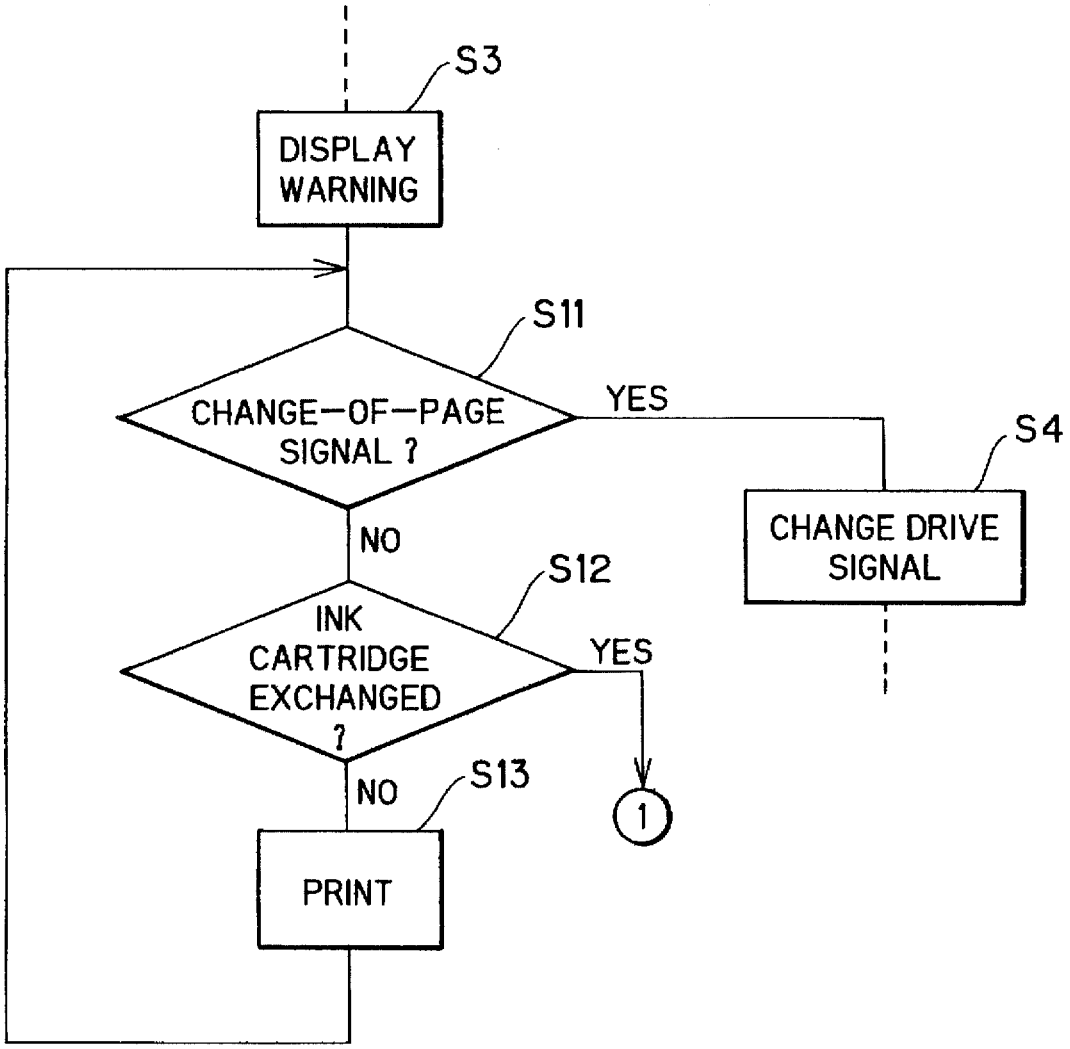
FIG. 5 is a flowchart illustrating a first modification of the print control sequence illustrated in FIG. 4.

For preventing this type of potential problem, two modifications of the first embodiment will be provided while referring to FIG. 5. FIG. 5 shows a modified section of the flowchart of FIG. 4.

In the first modification, the controller 20 changes the volume of ejected ink droplets starting from the following page after detecting little remaining ink. Three steps are added between the warning displayed in S3 and changing the drive signal in S4 of FIG. 4. After the warning is displayed in S3, the controller 20 determines in S11 whether or not a change-of-page signal was received after detection of the low ink level. If not, in S12 the controller 20 determines whether or not the ink cartridge 10 has been exchanged based on the detection results of the cartridge detector 23. If the ink cartridge 10 is determined not to have been exchanged, normal printing processes are continued in S13. If the ink cartridge 10 is determined to have been exchanged, the program returns to S2 of FIG. 4. When in S11 a change-of-page signal is determined to have been received, in S4 the drive signal is changed and S5 and on of FIG. 4 are performed for reducing the volume of ink droplets used in printing. In this way, the potential problem of two tones of printing occurring on the same page is solved.

Figure 6:
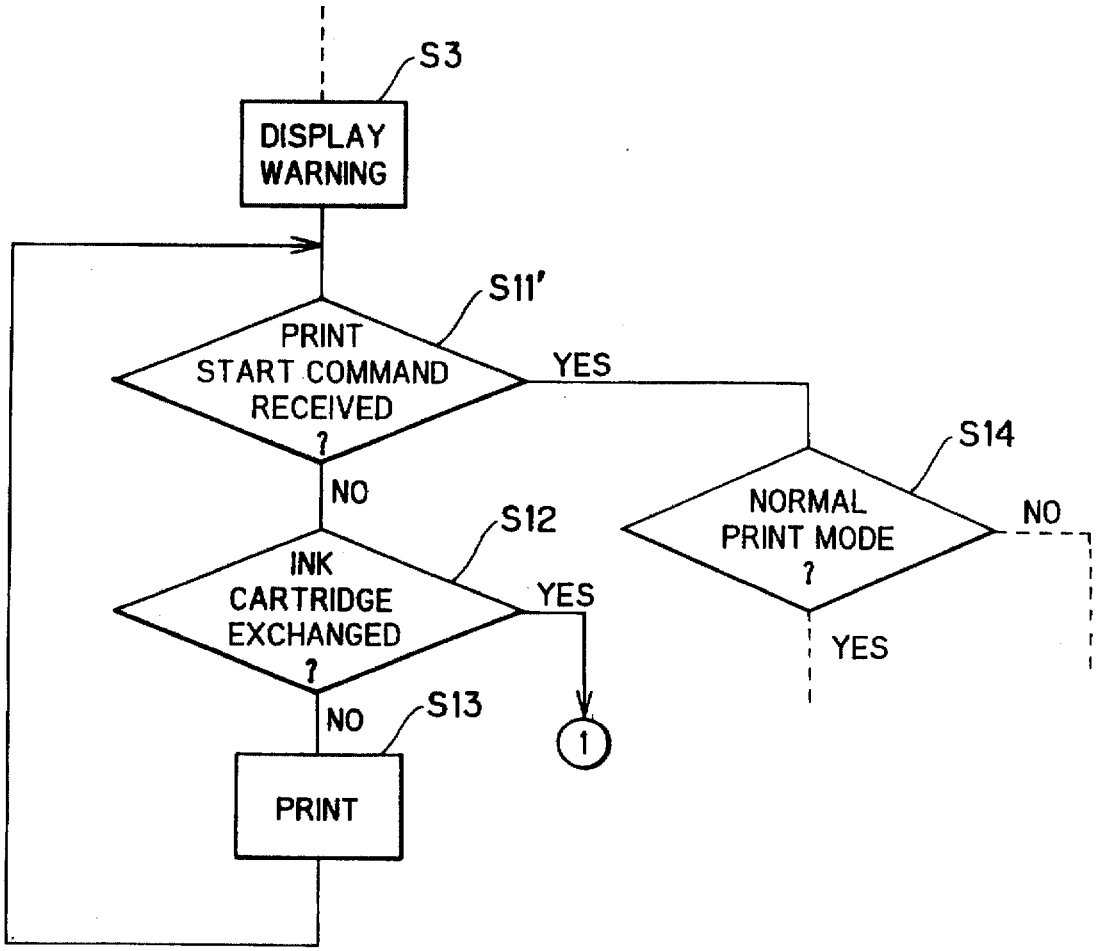
FIG. 6 is a flowchart illustrating a second modification of the print control sequence illustrated in FIG. 4.

In the second modification, in S11 of FIG. 6, whether or not a subsequent print start command has been received is determined rather than whether or not a change-of-page signal has been received. In this way, each series of printing operations will be continued without changes in the tone of printed images. The next series of printing operations will be continued using lower volume ink droplets.

A second embodiment of the present invention will be described while referring to the flowchart in FIG. 7. The second embodiment reduces the amount of ink per elected droplet only when printing is performed in the ink saving mode. When the low ink warning appears while a user is printing normally (i.e., while in the normal printing mode), printing is continued in the normal printing mode. When the low ink warning appears while a user is printing a draft of a document (i.e., while in the ink saving mode), printing is performed by ejecting ink droplets even smaller than those ejected in the ink saving mode. In this way, as much text as possible can be printed.

The processes until the warning is displayed in S3 are the same as those represented by the same step numbers in the flowchart in FIG. 4 so their description will be omitted here.

After the warning is displayed in S3, the controller 20 determines in S14 whether or not the presently selected printing mode is the normal printing mode. This determination is made based on whether or not the selection key 2*a* for switching between the normal printing mode and the ink saving mode is depressed. If determination made in S14 is YES, the program proceeds to S16. If NO, then the printing mode is presently the ink saving mode so the drive voltage is reduced to 15 volts in S15 in order to reduce the volume of each ejected ink droplet. As a result, each ejected ink droplet has a volume of about half the volume of each droplet ejected during normal printing.

Next, in S16, the controller 20 determines whether or not the ink cartridge 10 has been exchanged based on detection results from the cartridge detector 23. If not, in S17 printing processes are continued using the drive signal for normal printing or the drive signal modified in S15. If the ink cartridge 10 has been exchanged, the drive signal is changed in S18 back to its original waveform if the waveform was modified in S15. In S18, the remaining ink value stored in the non-volatile memory 21 is initialized. The program then returns to S2. When no data is left to be printed during either S2 or S17, the controller 20 terminates printing processes.

Figure 7:
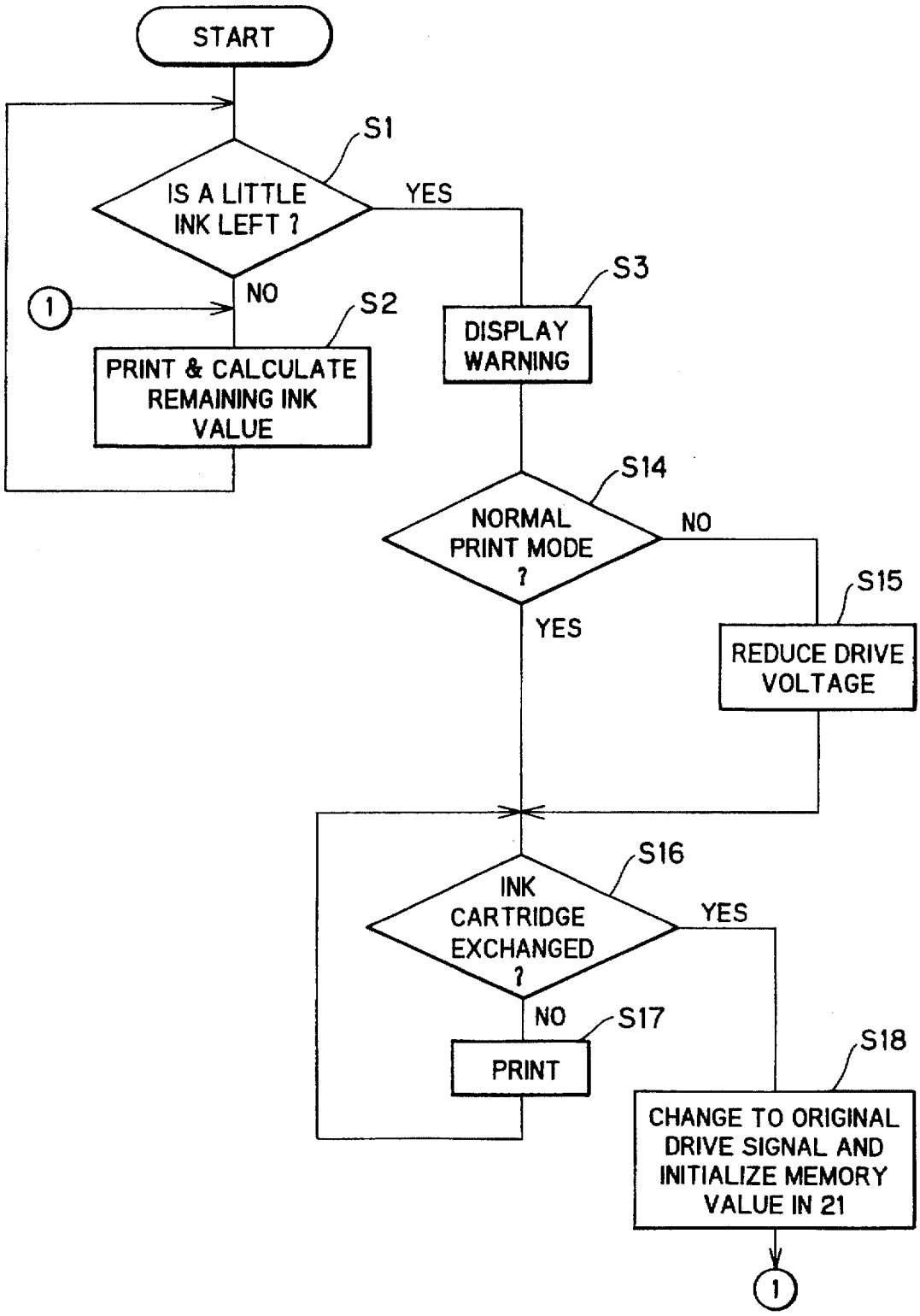
FIG. 7 is a flowchart illustrating a print control sequence of the word processor according to a second embodiment of the present invention.

The modifications shown in FIGS. 5 and 6 are equally applicable to the second embodiment in FIG. 7.

Figure 8:
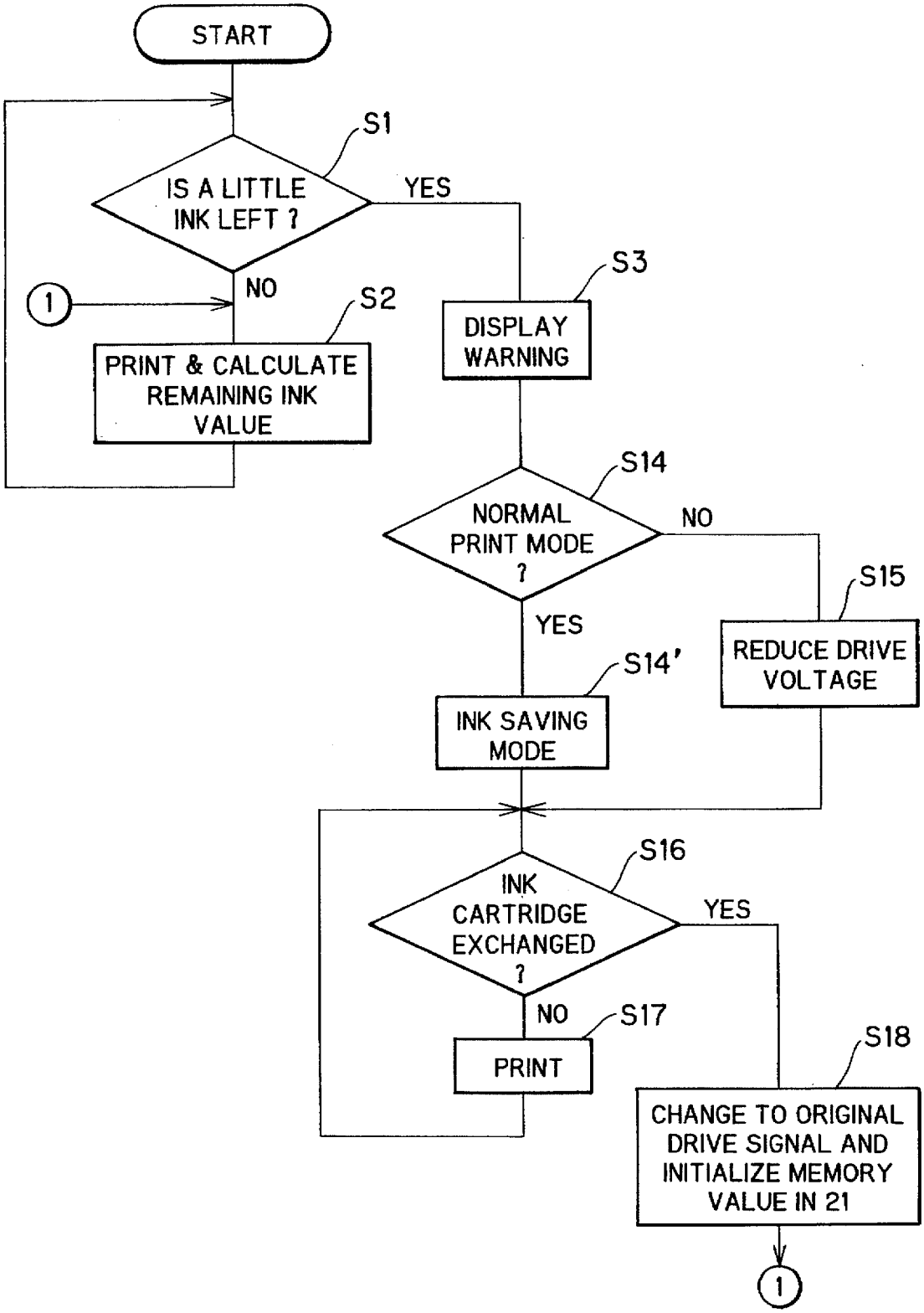
FIG. 8 is a flowchart illustrating a print control sequence of the word processor according to a third embodiment of the present invention.

A third embodiment of the invention will be described while referring to the flowchart in FIG. 8. The third embodiment is a modification of the second embodiment, wherein the normal printing mode is switched to the ink saving mode when only a little ink is determined to remain during normal printing. In the flowchart of FIG. 8, all steps with the same numbering as steps in FIG. 5 represent the same processes as for the same-numbered step of FIG. 5, so their description will be omitted here. When in S14 the controller 20 determines that the present printing mode is the normal printing mode (i.e., S14 is YES), the controller 20 causes further printing to be performed in the ink saving mode in S14'. If determination in S14 indicates that the present print mode is the ink saving mode (i.e., S14 is NO), the drive voltage is reduced to 15 volts in S15 in order to reduce the volume of ejected ink droplets. As a result, ink droplets are elected with a volume of about half that of droplets ejected during normal printing.

Next, in S16, the controller 20 determines whether or not the ink cartridge 10 has been exchanged based on detection results from the cartridge detector 23. If not, in S17 printing processes are continued using the drive signal for the ink saving mode or the drive signal modified in S15. If the ink cartridge 10 has been exchanged, in S18 the drive signal is changed back to its original waveform used during S14, that is, the waveform before being changed in S14' or S15. Also in S18, the remaining ink value stored in the non-volatile memory 21 is initialized. The program then returns to S2. When no data is left to be printed during S2 or S17, the controller 20 terminates printing processes.

As described above, the word processor 1 according to the above-described modification includes a function for reducing the volume of droplets ejected while only a little ink remains in the ink cartridge 10, that is, before it is replaced with a fresh cartridge 10. When little ink is found to remain while printing is being performed using the normal printing mode, the volume of ejected droplets is reduce to ⅔ by changing the mode to the ink saving mode. When little ink is found to remain while printing is being performed using the ink saving mode, the volume of ejected droplets is reduced to ½ by further reducing the drive voltage.

There are other methods of printing images with less ink than during the normal printing mode and the ink saving mode. For example, as an alternative to reducing the drive voltage for ejecting low-volume droplets, the duration (pulse width) at which the drive voltage is applied can be reduced to eject low-volume ink droplets. When switching from the normal printing mode to the ink saving mode, selective dots of dot patterns can be thinned out (i.e., not printed by not electing ink droplets for the dots) so that less ink overall is consumed for printing the same image. Alternatively, a combination of these methods can be used.

Next, a fourth embodiment of the present invention will be described while referring to the flowchart in FIG. 9. In this embodiment, before printing is started, the amount of ink which will be consumed for printing text or other images is compared with the amount of ink remaining. If not enough ink remains to completely record the text, printing will be performed by ejecting ink droplets with one half the volume of ink droplets ejected during normal printing.

Figure 9:
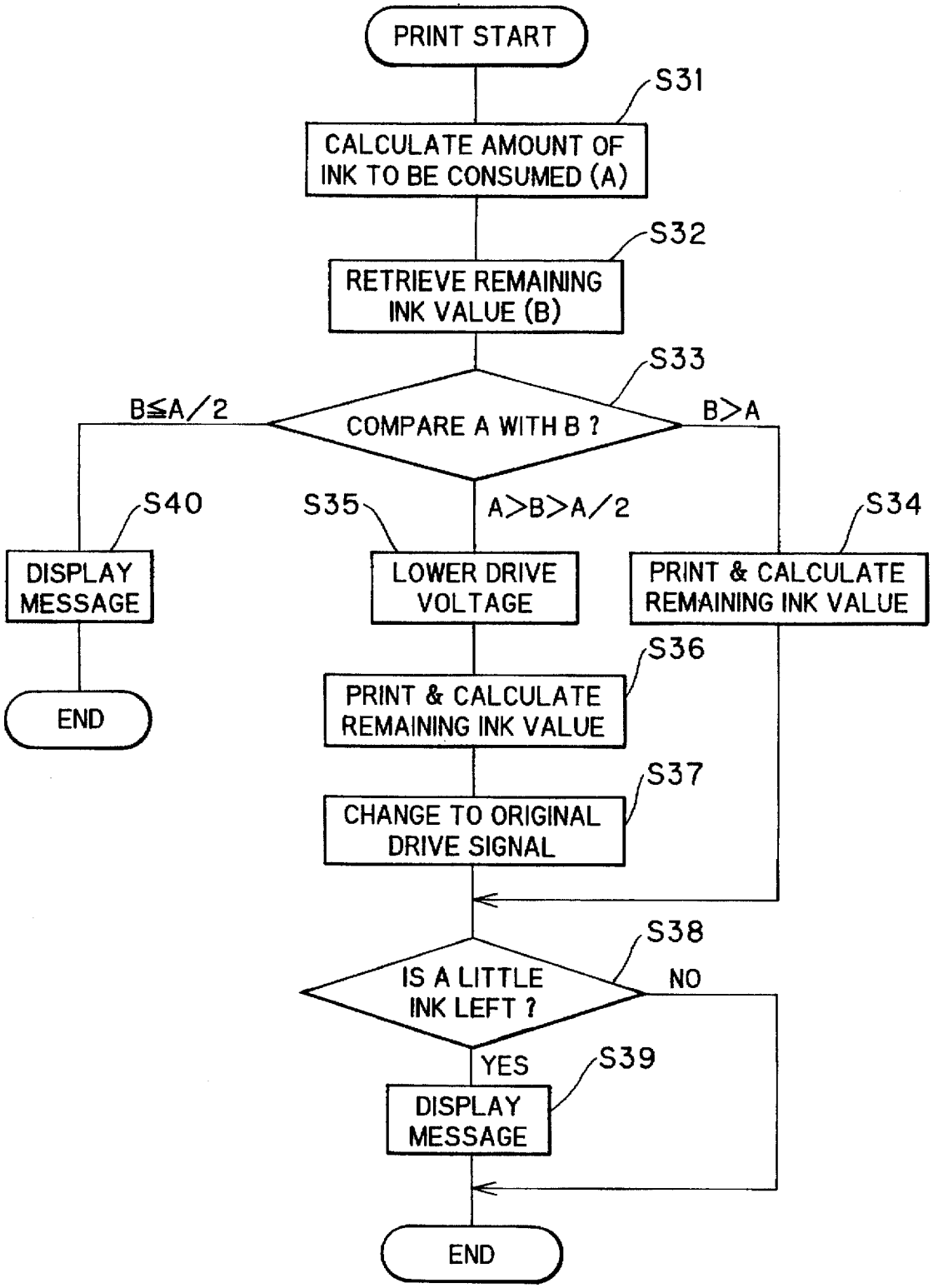
FIG. 9 is a flowchart illustrating a print control sequence of the word processor according to a fourth embodiment of the present invention.

Referring to the flowchart in FIG. 9, in S31, the controller 20 calculates using the above-described calculation method the amount of ink that will be consumed for printing the text (this amount will be represented with "A"). In S32, the controller 20 retrieves the remaining ink value stored in the non-volatile memory 21 (this amount will be represented with "B"). Next, in S33, the controller 20 compares the amount A of ink to be consumed (determined in S31) with the amount B of remaining ink (determined in S32). When more ink remains than will consumed, that means the ink cartridge 10 still contains enough ink to print the text. Therefore, in this case, the program proceeds to S34 where normal printing and, if necessary, also maintenance using the wiper 14 and the suction means 15 are performed. In S34, the controller 20 calculates the total ink consumption amount based on the amount of ink ejected, which is determined by a coefficient of the drive signal applied to the head 8, and the amount of ink suctioned, which is determined by a coefficient of the suction operation performed by the suction means 15, as described previously. The controller 20 converts the total ink consumption amount into the remaining ink value and accordingly updates the remaining ink value stored in the non-volatile memory 21. When printing of all text is completed, the program proceeds to S38 (to be described later).

If the amount of remaining ink (B) is determined in S33 to be less than the amount of ink that will be consumed (A), i.e., $B<A$, when printing the desired text, it is determined whether or not the amount of remaining ink (B) is more than one half the amount of ink that will be consumed (A/2), i.e., $B>\frac{1}{2}A$. That is, determination is made as to whether or not enough ink remains to print the desired text by ejecting ink droplets with half the volume of ink droplets used during normal printing. If so, the program proceeds to S35 where the drive voltage is reduced from 30 volts per drive pulse to 15 volts per drive pulse in order to reduce the volume of ejected ink droplets to one half the volume of those ejected during normal printing. More specifically, in the present embodiment the waveform of the drive signal for normal printing is formed from a 30 volts pulse with duration of L/a. This is the same as during normal printing in the first to third embodiments. In S35, the waveform is changed by reducing the drive voltage to 15 volts so that the volume of ejected ink droplets is one half the volume of droplets ejected during normal printing. In S36, all the text is printed at the modified drive voltage. The other processes performed in S34, such as maintenance and updating the remaining ink value, are also performed in S36. When printing is completed, the drive voltage is reverted to that for normal printing and the program proceeds to S38.

In S38, the controller 20 compares the updated remaining ink value stored in the non-volatile memory 21 with a reference value stored in the controller 20 and determines whether or not only a little ink is left in the ink cartridge 10. If only a little ink is left, in S9 the controller 20 displays a warning message accordingly on the display 3.

When it is determined in S33 that the ink cartridge 10 contains less than or equal to half the ink required to print all the text in the normal printing mode, i.e., $B \leqq A/2$, this means that it is impossible to record all the text even using ink droplets with half the size used during normal printing. Therefore, in S40 a message is displayed to change the ink cartridge 10 and the program is completed.

In the word processor according to the fourth embodiment, before printing starts, the amount of remaining ink is compared with the amount of ink required to print the desired text in the normal printing mode. When not enough ink remains, printing can be performed by ejecting ink droplets with half the volume of those elected during normal printing. Therefore, problems caused when an ink cartridge runs out of ink during printing, such as print sheets being outputted blank, or air entering and damaging the head 8, can be prevented. As much of the ink in the ink cartridge 10 can be used as possible so that running costs and production of waste can be curtailed.

A fifth embodiment of the present invention will next be described while referring to the flowchart in FIG. 10. In the fifth embodiment, a near end sensor is used to detect the amount of remaining ink in the ink cartridge 10. The near end sensors are provided to the ink cartridge 10 to detect whether a small amount of ink remains or not in the ink cartridge 10. The near end sensor is a pair of detection electrodes for observing changes in resistance values due to absence or presence of ink.

The fifth embodiment is similar to the fourth embodiment with the exception that the non-volatile memory 21 is unnecessary and the near end sensor is provided in the ink cartridge 10. The resistance between the electrodes of the near end sensor changes when the remaining amount of ink reaches a predetermined amount.

Figure 10:
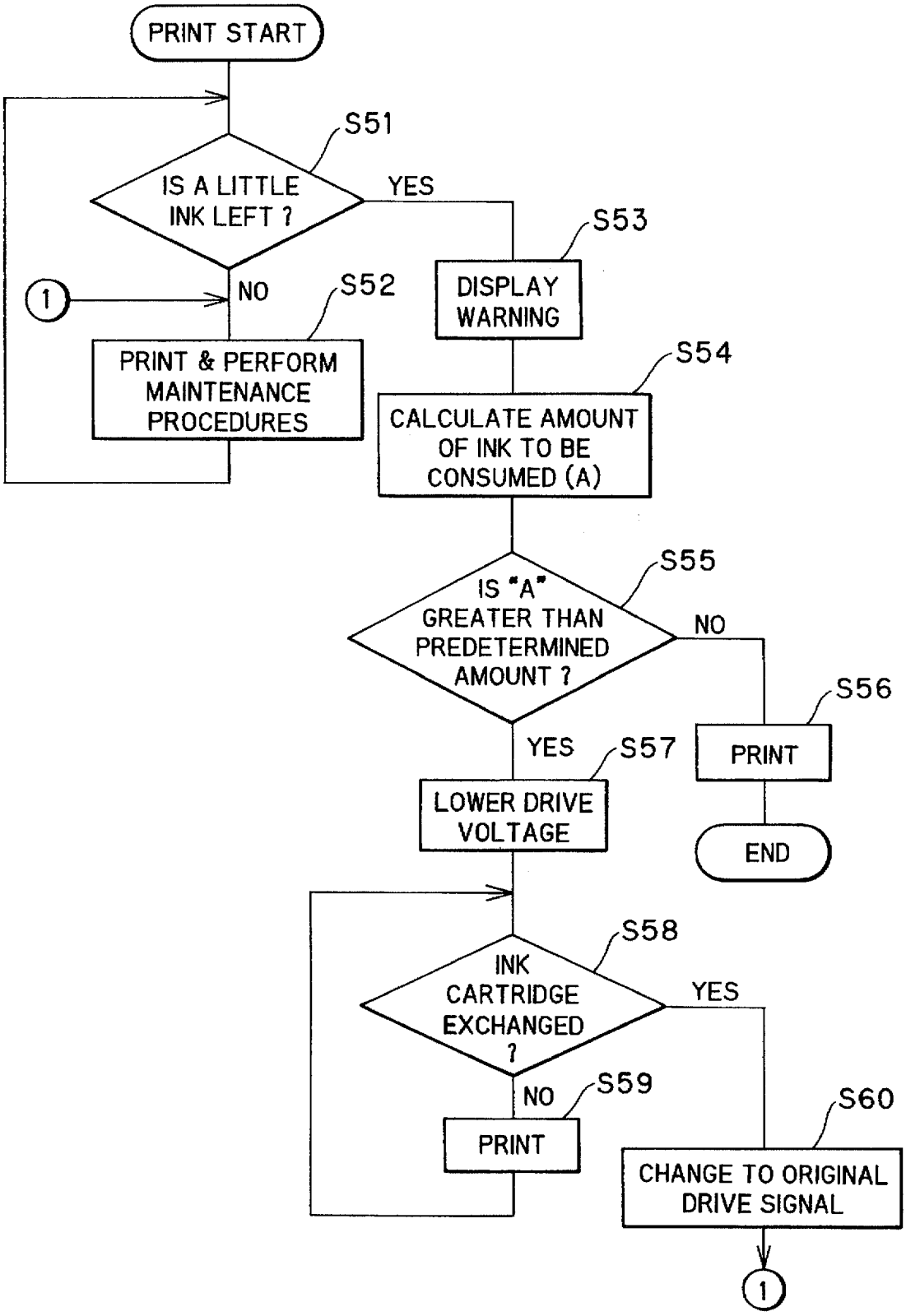
FIG. 10 is a flowchart illustrating a print control sequence of the word processor according to a fifth embodiment of the present invention.

Referring to the flowchart in FIG. 10, in response to a print start command, the controller 20 determines whether or not the remaining ink amount has reached a predetermined amount according to the output from the near end sensor in S51. When more than a little ink remains, i.e., more than the predetermined amount remains, normal printing and necessary maintenance processes are performed in S52. Because it is necessary to determine whether or not the remaining ink amount has reached a predetermined amount during printing processes, the controller 20 repeats the execution in S51 after each line is printed, so that the remaining amount of ink can be observed.

When only a little ink is determined in S51 to remain, the controller 20 displays a warning message to this effect on the display 3 in S53. Next, in S54, the amount of ink required to print the remaining text is calculated in the same manner as in the fourth embodiment. The controller 20 then compares the required amount of ink with the remaining ink (predetermined amount). If the remaining amount is greater, this means that all the remaining text can be printed without exchanging the ink cartridge. Therefore, normal printing is performed in S56 and then processes are completed.

On the other hand, when only a little ink is determined to remain, in S57 the controller 20 sets the drive voltage to be applied to the drive elements of the head 8 to 15 volts in order to reduce volume of ejected droplets to one half. Next in S58, whether or not the ink cartridge 10 has been exchanged is determined based on the detection of the cartridge detector 23. If not, printing processes are continued at the reduced drive voltage in S59. If the ink cartridge 10 is determined to have been exchanged, in S60 the drive signal is reverted to its original waveform for normal printing and the program returns to S52. When data to be printed runs out during printing in S59, the controller 20 terminates printing processes.

The program can be modified so that when the amount of ink remaining is determined in S55 to be less than half the amount needed to print the desired text, that is, when it is determined that the desired text can not be printed with the remaining ink even when half-sized ink droplets are ejected, a message indicating that printing the text is impossible because of lack of ink and that the cartridge should be exchanged can be displayed on the display 3, whereupon processes can be terminated.

In a word processor according to the fifth embodiment, even when the near end sensor, which detects only whether or not a little ink remains, is used, the same effects can be obtained as in the fourth embodiment.

As described in detail above, the word processor of the present invention ejects small volume ink droplets after it is detected that only a little ink remains in the ink cartridge 10 and until the ink cartridge 10 is exchanged. Therefore, chances are reduced that some problem related to lack of ink will occur even if an operator continues printing without exchanging the ink cartridge 10. Even when an operator accidentally misses the warning message on the display 3 about shortage of ink in the ink cartridge 10, the lighter toned text itself printed with smaller ink droplets will serve as a separate warning to the operator that only a little ink remains in the ink cartridge 10.

While the invention has been described in detail with reference to specific embodiments thereof, it would be apparent to those skilled in the art that various changes and modifications may be made therein without departing from the spirit of the invention, the scope of which is defined by the attached claims.

For example, there are alternative methods of reducing the volume of ejected droplets to a volume less than the volume of droplets ejected during normal printing. One method is to slightly shift the application timing of the drive pulse, whereby the timing at which pressure is applied to the ink pressure chamber and the timing at which the pressure wave is transmitted to near the orifice will be slightly off. Therefore, ejection efficiency will be slightly poorer so that slightly smaller volume droplets are ejected. Another method is to give a slant to the rising or falling edge of the drive pulse waveform, thereby reducing the ejection energy. Still another method is to modify the drive signal in such a manner that when a multi-pulse drive signal is used for normal printing, that is, when the waveform of the drive signal during normal printing is made up of a plurality of pulses, the drive signal can be changed to include less pulses when only a little ink is left in the ink cartridge. Each droplet will contain less ink because fewer pulses are applied to eject them. Another method is to perform thinning of the dots that make up each image. In this case, the volume per ejected droplet is remained unchanged but the total amount of ink used to print the image can be reduced. The total volume of ejected droplets can also be reduced by combining any of the above-described methods.

To provide more flexibility to the word processor, the key 2a can be set up with two modes. In one mode, the controller 20 automatically performs the function for reducing volume of ejected droplets after a low level of ink is detected. In the other mode, the controller 20 does not perform this function.

As mentioned previously, the amount of ink remaining can be determined using a well-known sensor added to the ink cartridge 10. In the above-described embodiments, the head 8 is fixed to the carriage 9 and the ink cartridge 10 is exchangeable in regards to the head 8. However, the ink cartridge and the head can be formed as an integrated unit that is exchangeable in regards to the carriage 9. Also, a refillable tank type ink reservoir can be provided to the head. When the level of ink runs low in the ink reservoir, it can be refilled.

Further, whether or not ink cartridge 10 was exchanged can be determined in other ways than the cartridge detector 23. For example, a cartridge exchange key (not shown in the diagrams) can be provided on the keyboard 2. Exchange of the cartridge 10 can be inputted to the controller 20 by an operator depressing the cartridge exchange key.

The present invention can be applied not only to a word processor but also to a facsimile machine or to a printer for printing data from a host computer.

According to the present invention, after a low level of ink is detected, printing is performed with small volume ink droplets or other ink saving method. Therefore, even when a user overlooks or ignores a warning about low levels of ink, problems that can occur when printing is performed without ink can be prevented. Even when a user misses a warning that the ink level is low, the user will be made aware that ink is low because images are printed with a different tone when ink runs low.

What is claimed is:

1. An ink ejection device comprising:

a head formed with orifices from which ink droplets are ejected to print a dot image on a printing sheet;

driving means for driving said head;

an ink reservoir holding ink, said ink reservoir being in fluid communication with said head for supplying the ink to said head;

remaining ink detection means for detecting ink remaining in said ink reservoir; and control means for controlling said driving means so that the dot image is printed on the printing sheet using less ink than is used during normal printing when said remaining ink detection means detects that less than a predetermined amount of ink remains in said ink reservoir.

2. An ink ejection device as claimed in claim 1, wherein when said remaining ink detection means detects that less than a predetermined amount of ink remains in said ink reservoir, said control means controls said driving means so as to form the dot image using less dots than used during normal printing.

3. An ink ejection device as claimed in claim 1, wherein when said remaining ink detection means detects that less than a predetermined amount of ink remains in said ink reservoir, said control means controls said driving means so as to start printing of the dot image using less ink than is used during normal printing when printing of a new page is instructed.

4. An ink ejection device as claimed in claim 1, wherein when said remaining ink detection means detects that less than a predetermined amount of ink remains in said ink reservoir, said control means controls said driving means so as to start printing of the dot image using less ink than is used during normal printing when printing of a new document is instructed.

5. An ink ejection device as claimed in claim 1, further comprising:

calculation means for calculating a predicted amount of ink that would be consumed in printing the dot image based on printing data and outputting a calculated result representative of the predicted amount of ink to be consumed; and comparison means for comparing the calculated result outputted from said calculation means with an amount of ink remaining in said ink reservoir and for outputting a control signal to said control means when the amount of ink remaining in said ink reservoir is less than the calculated result, wherein said control means controls said driving means so as to form the dot image using less ink than is used during normal printing in response to the control signal.

6. An ink ejection device as claimed in claim 5, wherein said remaining ink detection means detects whether or not the amount of ink remaining in said ink reservoir has reached a predetermined low level, and wherein said comparison means outputs the control signal when said remaining ink detection means detects that the amount of ink remaining in said ink reservoir has reached the predetermined low level.

7. An ink ejection device as claimed in claim 5, wherein said comparison means outputs the control signal before printing operations with said head are started.

8. An ink ejection device as claimed in claim 5, further comprising second calculation means for calculating a predicted amount of ink to be consumed in printing the dot image when using less ink than is used during normal printing and outputting a second calculated result representative of the predicted amount of ink to be consumed when using less ink, and wherein said comparison means outputs a second control signal to said control means when the second calculated result is greater than the amount of ink remaining in said ink reservoir, wherein said control means controls said driving means so as to interrupt printing operations.

9. An ink ejection device as claimed in claim 1, wherein said remaining ink detection means determines whether the amount of ink remaining in said ink reservoir is less than a predetermined amount, and said ink ejection device further comprising:

selection means for selecting between a normal printing mode wherein normal printing is performed and an ink saving mode wherein less ink is used for forming images than in the normal printing mode;

signal output means for outputting a save ink control signal to said control means when the remaining ink detection means determines that the amount of ink remaining in said ink reservoir is less than the predetermined amount while the normal printing mode is selected by said selection means, the save ink control signal causing said driving means to print in the ink saving mode.

10. An ink ejection device as claimed in claim 9, wherein said control means controls said driving means to print in the ink saving mode when printing of a new page is instructed.

11. An ink election device as claimed in claim 9, wherein said control means controls said driving means to print in the ink saving mode when printing of a new document is instructed.

12. An ink ejection device as claimed in claim 9, wherein said signal output means outputs a second save ink control signal when the remaining ink detection means determines that the amount of ink remaining in said ink reservoir is less than the predetermined amount while the save ink printing mode is selected by said selection means, wherein said control means controls said driving means to use less ink for forming the dot image than in the ink saving mode.

13. An ink ejection device as claimed in claim 9, wherein said remaining ink detection means further determines whether the amount of ink remaining in said ink reservoir is less than another predetermined amount that is less than the predetermined amount, and wherein said signal output means further outputs a further save ink control signal to said control means when the remaining ink detection means determines that the amount of ink remaining in said ink reservoir is less than the another predetermined amount while the ink saving mode is selected by said selection means, wherein said control means controls said driving means to print in a further ink saving mode that uses less ink than the ink saving mode in response to the further save ink control signal.

14. An ink ejection device as claimed in claim 9, wherein said control means controls said driving means so that said head ejects the ink droplets with larger volume during the ink saving mode than during the further ink saving mode.

15. An ink ejection device as claimed in claim 14, wherein said control means applies a driving signal having a voltage to said driving means, the voltage of the driving signal being lowered during the further ink saving mode than during the ink saving mode.

16. An ink ejection device as claimed in claim 14, wherein said control means applies a driving signal at a predetermined timing to said driving means, a timing at which the driving signal is applied to said driving means is changed during the further ink saving mode when compared with a timing at which the driving signal is applied to said driving means during the ink saving mode.

17. An ink ejection device as claimed in claim 14, wherein said control means applies a driving pulse having a rising edge and a falling edge to said driving means, at least one of the rising edge and the falling edge of the driving pulse being different during the further ink saving mode when compared with the rising edge and the falling edge of the driving pulse applied to said driving means during the ink saving mode.

18. An ink ejection device as claimed in claim 14, wherein a driving signal is formed from a plurality of pulses during the ink saving mode and at least one pulse during the further ink saving mode, the plurality of pluses for the ink saving mode being greater than the at least one pulse for the further ink saving mode.

19. An ink ejection device as claimed in claim 14, wherein said control means controls a driving signal applied to said driving means so that said head ejects fewer ink droplets to print the dot image during the further ink saving mode than to print the image during the ink saving mode.

20. An ink ejection device as claimed in claim 1, wherein said control means applies a driving signal having a voltage to said driving means, the voltage of the driving signal being lowered during the less ink printing than during the normal printing.

21. An ink ejection device as claimed in claim 20, wherein said control means applies a driving signal at a predetermined timing to said driving means, a timing at which the driving signal is applied to said driving means is changed during the further normal printing when compared with a timing at which the driving signal is applied to said driving means during the normal printing.

22. An ink ejection device as claimed in claim 20, wherein said control means applies a driving pulse having a rising edge and a falling edge to said driving means, at least one of the rising edge and the falling edge of the driving pulse being different during less ink printing when compared with the rising edge and the falling edge of the driving pulse applied to said driving means during the normal printing.

23. An ink ejection device as claimed in claim 20, wherein a driving signal is formed from a plurality of pulses during the normal printing and at least one pulse during less ink printing, the plurality of pluses for the normal printing being greater than the at least one pulse for the less ink printing.

24. An ink ejection device as claimed in claim 20, wherein said control means controls a driving signal applied to said driving means so that said head ejects fewer ink droplets to print the dot image during less ink printing than to print the image during the normal printing.

25. An ink election device as claimed in claim 1, further comprising selection means for selecting between a normal printing mode and an ink saving mode wherein less ink is used for forming images than in the normal printing mode, and wherein when the normal printing mode is selected by said selection means, printing is performed in the normal printing mode regardless of whether or not an amount of ink remaining in said ink reservoir has reached a predetermined low level, and when the ink saving mode is selected by said selection means, printing is performed in a further ink saving mode wherein less ink is used for forming images than in the ink saving mode.

* * * * *